US005526762A

United States Patent [19]

Kiley

[11] Patent Number: 5,526,762

[45] Date of Patent: Jun. 18, 1996

[54] POWER PLANING CATAMARAN

[76] Inventor: John C. Kiley, 338 North St., Medfield, Mass. 02052

[21] Appl. No.: 196,718

[22] Filed: Feb. 15, 1994

[51] Int. Cl.[6] ..... B63B 1/00

[52] U.S. Cl. ..... 114/61; 114/292

[58] Field of Search ..... 114/61, 56, 271, 114/57, 274, 283, 288, 290, 292

[56] References Cited

U.S. PATENT DOCUMENTS

| | | | |
|---|---|---|---|
| 450,350 | 4/1891 | Bruce . | |
| 911,806 | 2/1909 | Broward . | |
| 1,189,227 | 7/1916 | Baker . | |
| 1,204,355 | 11/1916 | Hickman . | |
| 1,620,349 | 3/1927 | Hickman . | |
| 2,515,005 | 7/1950 | Hickman . | |
| 2,666,406 | 1/1954 | Babcock . | |
| 2,815,730 | 12/1957 | Horsdal | 114/56 |
| 2,989,939 | 6/1961 | Tatter . | |
| 3,051,115 | 8/1962 | Canazzi . | |
| 3,067,711 | 12/1962 | Hesher et al. . | |
| 3,148,652 | 9/1964 | Canazzi . | |
| 3,216,389 | 11/1965 | Thorsen . | |
| 3,225,729 | 12/1965 | Ewing, Jr. . | |
| 3,259,092 | 7/1966 | Kara | 114/56 |
| 3,470,839 | 10/1969 | Faul et al. . | |
| 3,800,725 | 4/1974 | L'Heureux | 114/56 |
| 4,004,534 | 1/1977 | Allison . | |
| 4,086,863 | 5/1978 | Nitzki et al. | 114/61 |
| 4,091,761 | 5/1978 | Fehn . | |
| 4,348,972 | 9/1982 | Parsons . | |
| 4,574,724 | 3/1986 | Stolper . | |
| 4,924,792 | 5/1990 | Sapp et al. . | |
| 4,924,797 | 5/1990 | Solia . | |
| 5,038,696 | 8/1991 | Athanasiou et al. . | |

*Primary Examiner*—Stephen Avila
*Attorney, Agent, or Firm*—Bookstein & Kudirka

[57] ABSTRACT

A powered planing catamaran has a pair of asymmetric V-bottom hulls such that the inner surfaces of each of the hulls defines less of a deadrise angle than the outer surfaces. The inner surfaces define the primary running and planing surfaces. The bridging structure that connects the hulls defines an inverted tunnel-like channel that is broader at the bow end of the boat than the aft end and which defines an essentially inverted U-shaped configuration from amidships aft. A V-shaped nacelle is formed at the bow end of the underside of the bridging structure and is configured to dampen the slamming effect of waves at low speeds. At planing speeds, the nacelle is out of the water.

22 Claims, 2 Drawing Sheets

POWER PLANING CATAMARAN

FIELD OF THE INVENTION

This invention relates to power boats, particularly planing powered catamarans.

BACKGROUND OF THE INVENTION

Power catamarans may provide a number of advantages in a variety of applications and have become quite common. Depending on the intended use, some catamarans are designed to have high speed planing capability. Planing generally can be described as the action of a boat in motion when it lifts hydrodynamically and skims along the water surface. In order for a boat to plane, it must leave its stern wave behind and rise up over its bow wave. A common acknowledged definition of planing is based on the speed/length ratio, that planing occurs when the speed of the boat divided by the square root of its water line length is equal to or is greater than 2.0. A number of hydrodynamic variables come into play when planing, including the relationship between lift and drag, the angle of incidence of the planing surfaces to the water surface (the planing angle), the beam-to-length proportions of the hull (aspect ratio) and the bottom loading (boat weight per planing area).

A catamaran typically has certain advantages over a monohull of similar displacement or weight. Generally, the catamaran provides a wider deck space, improved lateral stability and may be considered to provide a more comfortable ride.

The conventional split-V planing catamaran is constructed so that its hulls plane on their outwardly facing bottom surfaces. At planing speeds, the majority of the water is displaced outwardly and downwardly while a certain amount of water is induced upwardly on the inside substantially vertical surfaces of each hull. The water that is displaced upwardly between the hulls contributes very little to the hydrodynamic lift but adds significantly to the overall drag of the hull. Such a hull, with adequate propulsion power to generate enough hydrodynamic lift to raise the center bridging supports and hull sides clear of the water may be considered to be acceptable up to moderate sea conditions. When carrying heavy loads, however, the performance, handling characteristics and comfort of the conventional split-V planing catamaran are significantly diminished due in part to the substantially increased wetted surface, the heavy bottom area loading and the effect of waves slamming against the underside of the transverse bridging structure between the hulls. While these difficulties might be reduced with a lightweight, high powered catamaran, such a catamaran may present severe control problems at high speeds because the air pressure on the underside of the bridging structure may cause the craft to become airborne, with its bow high and touching down on its transom. In an extreme case, a backward flip can result. In general, the performance and handling of a conventional split-V type of catamaran is very sensitive to weight.

Also among the characteristics of conventional split-V planing catamaran hulls is that they do not bank well and, therefore, tend to skid in high speed turns. They also may present difficulties in steering control when encountering quartering or cross waves. A further difficulty that may be encountered with conventional powered catamaran designs is that they may develop more of a wake than is desirable at low speeds.

It is among the general objects of the invention to provide an improved power planing catamaran hull configuration that provides improved performance in the foregoing and other respects.

SUMMARY OF THE INVENTION

In accordance with the invention, the hull construction for the catamaran includes a pair of asymmetric V-bottom hulls joined by a transverse bridging structure. The asymmetry of each of the hulls is such that the inner surfaces of each of the hulls defines less of a deadrise angle than the outer surfaces. The inner surfaces of the hulls, which define the primary running and planing surfaces, define a greater area below the water line than the outer surfaces of the hulls. The bridging structure that connects the hulls defines an inverted, tunnel-like channel is configured to utilize the energy imparted to the water that breaks clear from the inner hull surfaces in a manner that enhances the lift developed while reducing frictional resistance as well as absorbing surface wave impact. The water that is deflected upwardly and inwardly between the hulls mixes with air that is entrained within the channel and provides an aerated cushion of water under the center of the boat. The channel is essentially U-shaped from amidships aft. In a forward direction, the channel widens and rises toward the bow.

The hull also includes a nacelle that reduces the slamming effect that sometimes is encountered at low speed when a catamaran engages oncoming waves that hit the forward bridging area between the hulls. The nacelle, which is essentially V-shaped in cross-section, is normally well above the water surface at planing speeds but at slow speeds serves to dampen the slamming effect to divert water outwardly.

It is among the objects of the invention to provide an improved hull configuration for a powered planing catamaran that:

- provides improved lift capabilities;
- provides reduced frictional drag;
- generates greater lift at a reduced angle of running trim;
- displays good stability at high speeds;
- generates reduced wake at lower speeds;
- generally provides for a more comfortable ride, especially in rough water;
- provides improved stability at heel angles;
- provides improved steering control when turning and maneuvering at planing speeds
- provides increased banking ability in turns with consequently less sliding.

DESCRIPTION OF THE DRAWINGS

The foregoing and other objects and advantages of the invention will be appreciated more fully from the following further description thereof, with reference to the accompanying drawings wherein:

FIG. 9A is a diagrammatic sectional illustration of a typical hard chine;

FIG. 9B is a diagrammatic sectional illustration of a typical chine flat;

FIG. 9C is a diagrammatic sectional illustration of a typical external chine flat;

FIG. 9D is a diagrammatic sectional illustration of a combined chine flat and lift strip; and FIG. 9E is a diagrammatic sectional illustration of a plurality of chine flats.

DESCRIPTION OF THE PREFERRED EMBODIMENT

Figure 1:
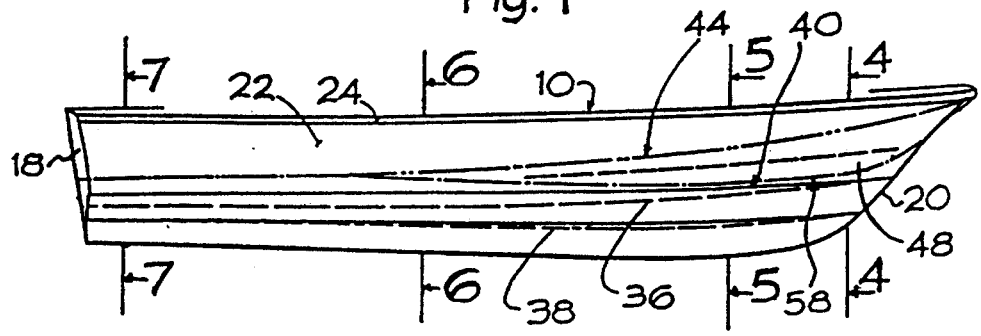
FIG. 1 is a starboard side elevation of the hull.
Figure 2:
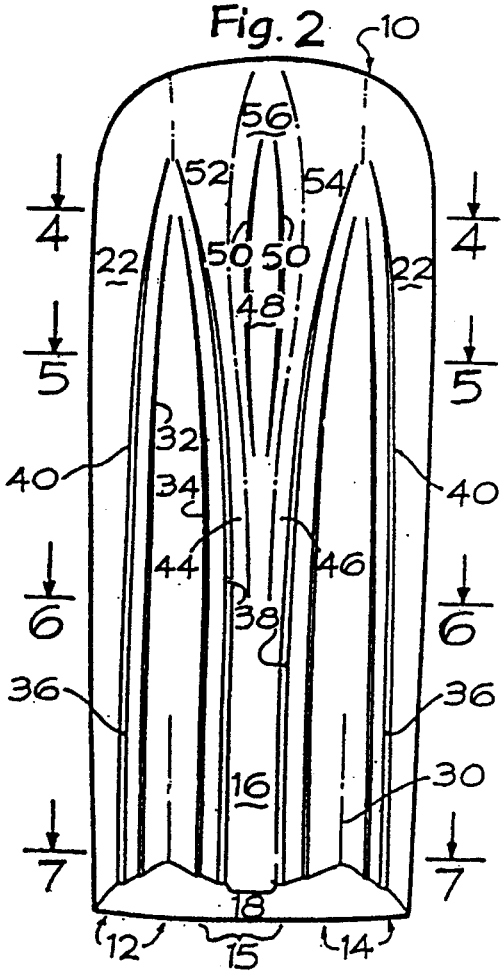
FIG. 2 is an illustration of the hull as viewed from the bottom.

The hull may be constructed in a variety of conventional boat building techniques utilizing a variety of conventional boat building materials such as, for example, combinations of fiberglass and suitable resins as is well known in the art. As shown in FIGS. 1 and 2, the hull 10 comprises a pair of transversely spaced, longitudinally extending hull sections 12, 14 that are connected by a transversely extending bridging structure 15.

In the following description the same reference numeral will be used to designate like parts on each of the two mirror-image hull sections 12, 14. The underside of the bridging structure 15 and the inwardly facing surfaces of the hull sections 12, 14 cooperate to define a longitudinally extending tunnel 16. The hull also includes a transom 18 at its aft end, each hull section 12, 14 having a bow 20, respectively. Each hull section also has an outwardly facing topsides 22, respectively, that terminates along its upper edge at a gunwale 24 which also may serve as the deck line.

The hull sections 12, 14 each include bottom panels 26, 28 (see FIGS. 4–7) that define the planing surfaces of the hulls. The inner and outer bottom portions 28, 26 are joined at their lower edges at a longitudinally extending, tapering bottom radius 30 that extends from transom 18 to the bow stem 20.

The deadrise angle A (the angle measured to the horizontal) defined by the outwardly facing bottom panel 26 is, for most of the hulls length, greater than the deadrise angle B of the inwardly facing bottom panel 28. Additionally, the deadrise angle of each inwardly facing bottom panel 28 defines a twisting plane that tends to twist toward the horizontal as seen in a direction from bow to stern (see FIGS. 4–7). The change in deadrise angles provides a bottom twist throughout the inner planing surfaces 28 and defines a greater area of exposed planing bottom surface and volumetrically greater proportion of displacement for the inwardly facing surfaces 28 than for the outwardly facing surfaces 26. The amount of deadrise twist in the outer surfaces 26 is substantially less than the deadrise twist of the inwardly facing surfaces 28. The distinction between inner facing and outer facing panels contributes significantly to the unique asymmetric nature of the present invention.

Figure 6:
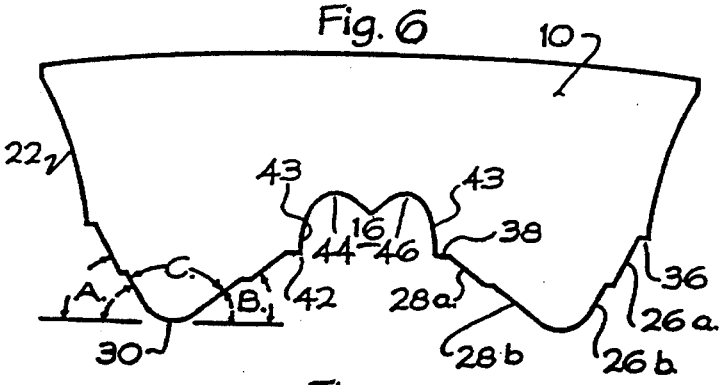
FIG. 6 is a diagrammatic cross-sectional illustration of the external hull surface as seen along the line 6—6 of FIGS. 1 and 2.

Preferably, the inner facing panels 28 and the outer facing panels 26 intersect at an included angle C of about 90° at a location approximately midship of each hull, as illustrated in FIG. 6. As can be seen from the progressive changes from FIG. 4 to FIG. 7, the included angle C increases progressively from the bow toward the transom.

Figure 8:
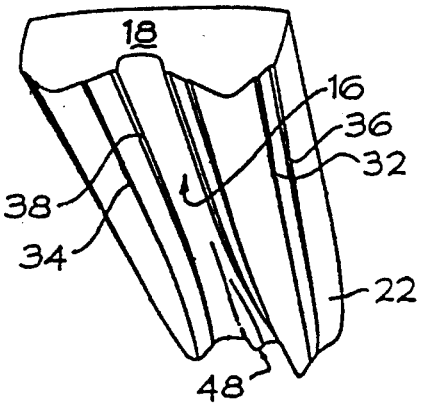
FIG. 8 is an oblique underside view of the hull, after its transom.
Figure 4:
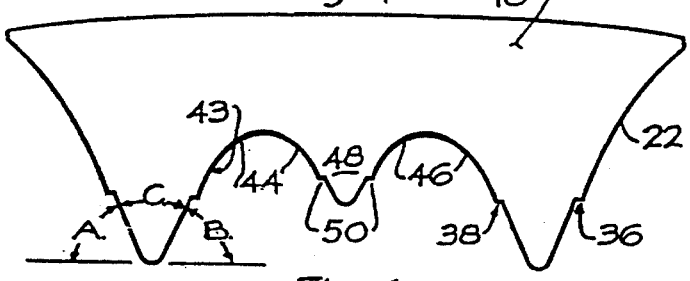
FIG. 4 is a diagrammatic cross-sectional illustration of the external hull surface as seen along the line 4—4 of FIGS. 1 and 2.
Figure 5:
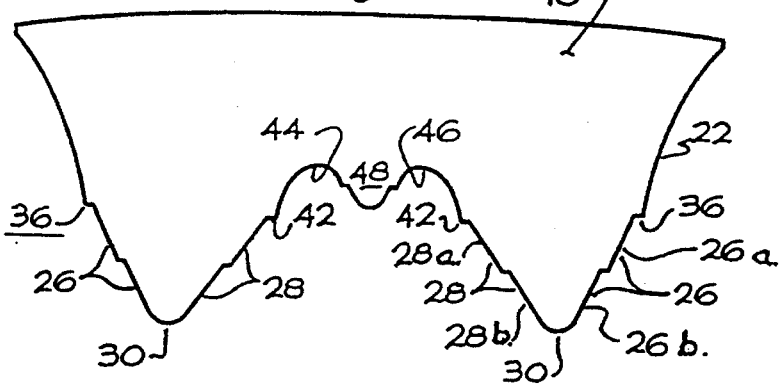
FIG. 5 is a diagrammatic cross-sectional illustration of the external hull surface as seen along the line 5—5 of FIGS. 1 and 2.
Figure 7:
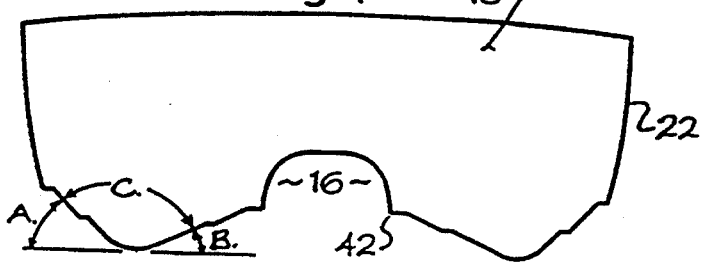
FIG. 7 is a diagrammatic cross-sectional illustration of the external hull surface as seen along the line 7—7 of FIGS. 1 and 2.
Figure 7:
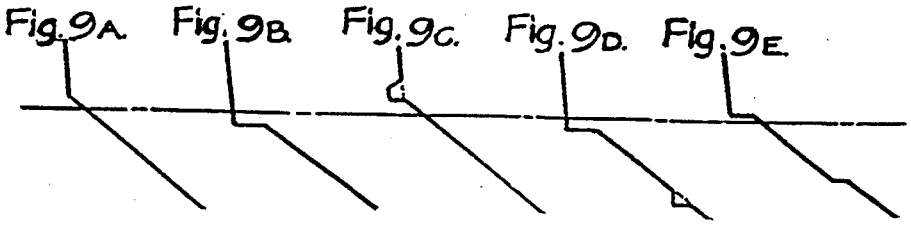

Each of the inner hull panels 28 and outer hull panels 26 preferably is interrupted by a longitudinally extending, horizontally oriented lower chine flat 32, 34, respectively. The flats 32, 34 serve to facilitate development of hydrodynamic lift to raise the boat to a planing condition. Each chine flat (or lifting strip) may be considered as dividing each bottom panel 26, 28 into two distinct, parallel subpanels designated by the reference characters 26*a*, 26*b*, 28*a*, 28*b*. The lower subpanels 26*b*, 28*b* are tangent to the bottom radius 30 and intersect the lower chine flats. The upper subpanels 26*a*, 28*a* intersect the lower chine flats and are joined to upper chine flats 36, 38. The subpanels of any of the panels 26 or 28 have the same deadrise angle at any location along the length of that panel and, therefore, are parallel within their respective panels. The upper and lower chine (or lift strip) flat widths taper to zero in a gradual transition from the transom to the bow. The lower edge of the topsides 22 intersects the upper chine flat corners as indicated at 40. The inner chine corner intersection lines 42 serve to divide the bottom planing portions from the region of the tunnel 16. As illustrated in FIGS. 7 and 8, the aft portion of the tunnel 16, from the section lines 6—6 to the transom 18 is defined by two inwardly facing sidewalls 43 joined longitudinally by tapering curved upper walls 44, 46 to a longitudinally extending top channel wall that rises in height forwardly.

It should be noted that although the invention has been illustrated with one type of chine flat, other configurations of the flats and chines may be employed as suggested in FIGS. 9A to 9D, the illustration in FIG. 9E being similar to the present embodiment. The chine flat configuration may be effected or dictated by the type of material and construction from which the hull is made. For example, some configurations may be better suited to a hull made from metal whereas others may be better suited to other construction techniques and materials.

Figure 3:
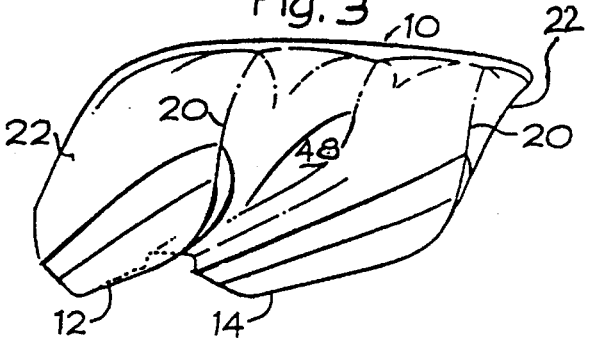
FIG. 3 is an oblique illustration of the hull as viewed from beneath, forward and somewhat starboard of the hull.

The top of the tunnel rises and widens gradually (FIG. 2) to accommodate the central V-nacelle 48. The central longitudinally extending nacelle 48 is symmetrical in cross-section and is constructed with chine flats 50 that taper in width. Above chine flats 50, the surface flares outward to form twin, mirror-image flute-like passages 52, 54 that are bounded by the chine flat intersection lines and have their forward termination at the central bow portion indicated at reference numeral 56 (FIG. 3). As shown (FIG. 1), the lower edge 58 of the nacelle 48 is no lower than about the height of the upper outside chine flat 36.

It is believed that the foregoing hull configuration improves on prior powered catamarans in a number of respects. For example, it combines the attributes of hydrodynamic lift, reduction in surface drag and water deflection commonly found on deep V-type monohulls with the aerated water lift characteristics of an inverted V-type monohull to achieve better load carrying capabilities, improved handling and sea-keeping ability than prior planing catamaran powered boats.

Further advantage of the present invention is that because the major portions of the wave making planes face inwardly toward each other, the accompanying wakes tend to collapse inwardly on each other, tending to cancel each other's force and dissipating more quickly behind the boat. This is a particular advantage in crowded harbors and rivers where low wake requirements are in effect. In a further aspect of the invention, the configuration of the channel and inwardly facing panels is such that at higher, planing speeds, the water that is deflected upwardly and inwardly into the channel is mixed with air that is ingested into the channel to aerate the water. That, in turn, tends to disrupt boundary layer effects and reduce hydrodynamic drag. Additionally, it has been observed, at higher planing speeds that the aerated water emitted aft from the transom end of the channel seems to emerge in a jet-like manner and may enhance the thrust that the propulsion system generates. Additionally, the narrowing of the channel in an aft direction also tends to increase the static air pressure within the channel. That is believed to provide a relatively stable pressure center within the channel that may tend to damp the fore and aft pitching motion of the boat.

The asymmetrical configuration of the hulls enhances the ability of the boat to bear down on one hull with better control than has been achieved with previous planing hulls, particularly when encountering cross seas at high speeds. At 15°–20° angle of heel (bank) from the horizontal, the deadrise angles A, B of the inner and outer facing planing surfaces become nearly symmetrical. In such a banked condition, the nearly balanced running lines help to neutralize the skidding effect normally encountered with symmetrical V-bottom hulls, particularly when in cross sea conditions. Thus, the asymmetric bottom configuration also produces better steering control in turning and maneuvering at planing speeds. The normal tendency for a split-V catamaran powering into a sharp turn is for it to change course at a nearly flat angle, not allowing any significant banking effect. This can be disconcerting, if not dangerous. Additionally, a high speed split-V catamaran may tend to turn erratically because of the pressure differential between the outwardly facing bottom surface and the inner wall of the opposite hull. In rough water it can have a tendency to trip on the inside bottom corner of the inner hull causing unpredictable oscillations. With the present invention, the turning radius is relatively small and is not proportional to its speed as tends to be the case with a conventional split-V catamaran hull. Rather, the present invention displays a tendency to bank slightly but to skid significantly less than a split-V catamaran. With the present invention, the radiused sections at the bottom of each hull, coupled with its high deadrise, asymmetric bottoms presents a catamaran configuration with a reduced tendency to trip and roll outward on a high speed turn.

The central tunnel may accept a single conventional shaft propulsion system that can function on the center line of the boat satisfactorily. A single center line propulsion has the advantages of simplicity, low cost and a degree of protection for the underwater gear uncommon in a planing craft.

The catamaran hull of the present invention also tends to roll more gradually than prior power catamaran hulls. This is an important characteristic in consideration of comfort and safety while operating at low speed or at rest. The major portions of the displacement are carried on the inner bottom surfaces, diminishing gradually toward the center. This tends to abate the uncomfortable quickness of roll or snapping back that may be encountered with the split-V catamaran which carries its buoyant volume farther apart.

The nacelle serves to dampen the slamming effect of an oncoming wave when the boat operates at relatively slow speeds. The nacelle, when engaging the wave, diverts the water outwardly to the adjacent curved passages that form the forward portion of the central tunnel. At higher, planing speeds, the nacelle is well out of the water and provides no hydrodynamic benefit. It does provide additional reserve buoyancy when putting the bow down the trough of a following sea wave at planing speed. Additionally, the V-shaped nacelle adds strength and web depth to the cross-sectional form of the forward bridging structure. The form allows lighter material construction to handle the torsionally stress that will develop between the hulls.

It should be understood that the foregoing description of the invention is intended merely to be illustrative thereof and that other modifications and embodiments may be apparent to those skilled in the art without departing from the spirit.

Having thus described the invention, what I desire to claim and secure by letters patent is:

1. A catamaran hull comprising:

a pair of transversely spaced, longitudinally extending hull sections, each having a forwardly disposed bow, a rearwardly disposed transom and an asymmetrical V-shaped cross-section;

each hull section including inner and outer surfaces defining inner and outer downwardly converging bottom panels, the inner bottom panel having a lower deadrise angle and a greater surface area, below the water line, than the outwardly facing bottom panel along most but not all of the length of the hull section;

a topside panel disposed above the outer bottom panel;

the hull sections being joined to each other by a transversely extending bridging section;

the underside of the bridging section, between the inwardly facing surfaces of the hull sections having surfaces defining a longitudinal, inverted channel that widens and rises toward the bow, the longitudinally inverted channel being substantially U-shaped in cross-section from approximately the midships of the hulls to the transom and defining surfaces being distinct from the inner bottom panel.

2. A catamaran hull as defined in claim 1 further comprising:

an outer chine flat extending longitudinally along the outer surface of each of the hulls.

3. A catamaran hull as defined in claim 2 further comprising at least one lifting strake formed longitudinally along the outer bottom panel of each hull.

4. A catamaran hull as defined in claim 3 further comprising a chine flat and lifting strake on the bottom inner panel of each hull.

5. A catamaran hull as defined in claim 1 further comprising:

a V-section nacelle formed centrally at the forward under surface of the bridging member, beginning at the bow, progressing aft, tapering upwards and merging into the inverted channel before reaching the transom and having a bottom edge.

6. A catamaran hull as defined in claim 5 further comprising:

chines extending along the outer surface of each of the hulls such that the bottom edge of the nacelle is disposed not substantially lower than the level of the chines of the hull section.

7. A catamaran hull as defined in claim 5 wherein the nacelle has chine flats formed longitudinally along its sides.

8. A catamaran hull as defined in claim 1 wherein the inner bottom panels are disposed at an angle inclined to the vertical.

9. A catamaran hull as defined in claim 1 wherein the inner and outer downwardly converging bottom panels are joined at a longitudinally extending, tapering bottom radius that extends the entire length of the hull.

10. A catamaran hull of claim 4 wherein the chine flat serves to divide the bottom inner panel of each hull from the channel-defining surfaces.

11. A catamaran hull comprising:

a pair of transversely spaced, longitudinally extending hull sections, each having a forwardly disposed bow, a rearwardly disposed transom and an asymmetrical V-shaped cross-section;

each hull section including inner and outer surfaces defining inner and outer downwardly converging bottom panels, the inner bottom panel having a lower deadrise angle and a greater surface area, below the water line, than the outwardly facing bottom panel along most but not all of the length of the hull section and the inner bottom panels defining a longitudinally extending twist that changes progressively toward a smaller angle to the horizontal when viewed in an aft direction;

a topside panel disposed above the outer bottom panel;

the hull sections being joined to each other by a transversely extending bridging section;

the underside of the bridging section, between the inwardly facing surfaces of the hull sections having surfaces defining a longitudinal, inverted channel that widens and rises toward the bow, the channel defining surfaces being distinct from the inner bottom panel.

12. A catamaran hull as defined in claim 11 further comprising:

the degree of twist on the inner lower panel being greater than the degree of twist on the outer lower panel.

13. A catamaran hull as defined in claim 11 wherein the included angle between the inner and outer bottom surfaces of each hull is approximately 90° at about midships of the hull sections, the included angle being less at more forward locations and greater at more aft locations.

14. A catamaran hull as defined in claim 11 further comprising:

an outer chine flat extending longitudinally along the outer surface of each of the hulls.

15. A catamaran hull as defined in claim 14 further comprising at least one lifting strake formed longitudinally along the outer bottom panel of each hull.

16. A catamaran hull as defined in claim 15 further comprising a chine flat and lifting strake on the bottom inner panel of each hull.

17. A catamaran hull as defined in claim 11 further comprising:

a V-section nacelle formed centrally at the forward under surface of the bridging member, beginning at the bow, progressing aft, tapering upwards and merging into the inverted channel before reaching the transom and having a bottom edge.

18. A catamaran hull as defined in claim 17 further comprising:

chines extending along the outer surface of each of the hulls such that the bottom edge of the nacelle is disposed not substantially lower than the level of the chines of the hull section.

19. A catamaran hull as defined in claim 17 wherein the nacelle has chine flats formed longitudinally along its sides.

20. A catamaran hull as defined in claim 11 wherein the inner bottom panels are disposed at an angle inclined to the vertical.

21. A catamaran hull as defined in claim 11 wherein the inner and outer downwardly converging bottom panels are joined at a longitudinally extending, tapering bottom radius that extends the entire length of the hull.

22. A catamaran hull of claim 16 wherein the chine flat serves to divide the bottom inner panel of each hull from the channel-defining surfaces.

* * * * *